US005975863A

United States Patent [19]

Mazzucato

[11] Patent Number: 5,975,863

[45] Date of Patent: Nov. 2, 1999

[54] HIGH PRESSURE WATER PUMP SYSTEM

[75] Inventor: Roberto Mazzucato, Milan, Italy

[73] Assignee: Officine Meccaniche FAIP S.r.l., Italy

[21] Appl. No.: 08/764,055

[22] Filed: Dec. 12, 1996

[30] Foreign Application Priority Data

Dec. 20, 1995 [IT] Italy ..... MI95A2689

[51] Int. Cl.[6] ..... F04B 1/12

[52] U.S. Cl. ..... 417/269; 417/360; 92/71

[58] Field of Search ..... 417/269, 360; 92/71; 384/622, 621, 620

[56] References Cited

U.S. PATENT DOCUMENTS

| | | | |
|---|---|---|---|
| 4,495,855 | 1/1985 | Murakami et al. | 92/71 |
| 4,771,677 | 9/1988 | Rhode et al. | 92/57 |
| 4,781,539 | 11/1988 | Ikeda et al. | 417/269 |
| 4,784,045 | 11/1988 | Terauchi | 92/71 |
| 5,011,377 | 4/1991 | Sagawa et al. | 417/269 |
| 5,131,319 | 7/1992 | Ono et al. | 92/71 |
| 5,395,053 | 3/1995 | Frech | 239/227 |
| 5,415,077 | 5/1995 | Ono | 92/71 |
| 5,494,414 | 2/1996 | Steinhart et al. | 417/360 |
| 5,586,870 | 12/1996 | Kawaguchi et al. | 417/222.2 |
| 5,653,584 | 8/1997 | Mazzucato et al. | 417/360 |
| 5,791,882 | 8/1998 | Stucker et al. | 417/269 |

*Primary Examiner*—Timothy S. Thorpe
*Assistant Examiner*—Ehud Gartenberg
*Attorney, Agent, or Firm*—Leydig, Voit & Mayer, Ltd.

[57] ABSTRACT

A high pressure water pump system, including a motor (20), an intermediate flange (30) and an axial drive water pump (60) wherein the intermediate flange unites the motor and the high pressure water pump. A wobble disk assembly (62) is attached to an end of the drive shaft of the motor and located in a second recess (36) of the intermediate flange. The intermediate flange (30) is shaped to receive the wobble disk assembly (62). Thrust bearings, consisting of thrust washers (41) and cylindrical or spherical rollers (42), are located in a first recess (34) of the intermediate flange (30) and act on a part of the wobble disk assembly. A bushing (43) made of sintered ferrous material or of plastic material is press-fitted between the first recess (34) and the back part (63) of the wobble disk assembly (62). A plug (45) is applied to the end of the drive shaft (22).

23 Claims, 3 Drawing Sheets

HIGH PRESSURE WATER PUMP SYSTEM

FIELD OF THE INVENTION

This invention concerns a high pressure water pump system. The high pressure pump system of the present invention uses a uniquely shaped intermediate flange that includes a recess for one or more thrust bearings and a recess for a wobble disk assembly that together provide a method for uniting a motor to an axial drive pump.

The high pressure water pump system of the present invention uses an intermediate flange, including at least one thrust bearing to unite the vertically mounted motor to an axial drive pump.

DESCRIPTION OF THE PRIOR ART

Small high pressure water pumps driven by motors are well known in the art. For example, U.S. Pat. No. 5,395,052 describes a high pressure cleaning device where the motor, including the motor drive shaft, is horizontally oriented. U.S. Pat. No. 5,494,414 discloses a pressure washer having a vertically oriented axial piston pump driven by an internal combustion engine.

Other commercially available high pressure water pump systems include horizontally mounted motors or vertically mounted motors that include a shaft sleeve that is eliminated by the complying system used in this invention.

SUMMARY OF THE INVENTION

Small, reliable high pressure water pump systems are gaining popularity among users. Presently available high pressure water pump systems are inexpensive, reliable, compact, and easy to use. They are also useful for a variety of purposes, some of which include washing automobiles and home sidings. The majority of high pressure water pumps purchased by consumers are horizontally oriented because conventional motors used in high pressure water pump systems must typically be associated with gear reducers or shaft sleeves in order to efficiently operate the pump using a rotating motor drive shaft. This makes the pump system quite long and, therefore, awkward for vertical mounting.

It is an object of this invention, therefore, to provide a vertically or horizontally oriented high pressure water pump system that is shorter in length than conventional high pressure water pump systems.

It is another object of this invention to provide a high pressure water pump system that is compatible with standard consumer motors such as internal combustion or electric motors used in consumer lawn mowers.

It is yet another object of this invention to provide a high pressure water pump system that includes at least one thrust bearing associated with an intermediate flange that allows the drive shaft of a motor to be directly connected to an axial drive pump.

In one embodiment, this invention is a high pressure water pump system comprising a motor, having a motor housing and a downwardly oriented vertical drive shaft and an axial drive pump that is driven by the motor drive shaft. An intermediate flange is positioned between the motor and the pump. The intermediate flange includes an aperture and a first recess. A means for uniting the pump and the motor compressively fixes the intermediate flange between the motor and the axial drive pump. At least one thrust bearing is located in the first recess of the intermediate flange. A wobble disk assembly is attached to the end of the motor drive shaft and located within the intermediate flange in such a way that the wobble disk shaft passes through the intermediate flange aperture and such that the primary position of the wobble disk assembly is located in intermediate flange second recess. The wobble disk assembly is hollow, has a length at least equal to its diameter and is provided with a seat for a connection means to the drive shaft. The rotation of the drive shaft causes the rotation of the wobble disk assembly which drives the axial drive piston pump.

In a preferred embodiment, a cylindrical bushing is fitted around the external surface of the wobble disk assembly shaft and located between said disk shaft and the intermediate flange. The bushing allows the wobble disk assembly to be centrally located in the aperture of the intermediate flange during the assembly of the pump system of this invention.

A plug may be applied to the end of the motor drive shaft. The plug fits tight in a cylindrical cavity formed in an aperture that passes through the center of the wobble disk assembly. The plug prevents seepage of lubricating oil between the drive shaft and the wobble disk assembly especially during protracted use of these pumps in drastic conditions.

According to another embodiment of the high pressure water pump of this invention, a metal disk may be connected to the wobble disk assembly in correspondence of its end oriented towards the motor, so as to prevent any possible unthreading of the same disk from the drive shaft during the assembly of the pump.

DESCRIPTION OF THE DRAWINGS

The high pressure water pump system of the present invention can be better understood from the following description, wherein reference is made to the figures of the herewith enclosed drawings which represent some preferred, exemplified but non limitative embodiments of the present invention and wherein.

Figure 1:
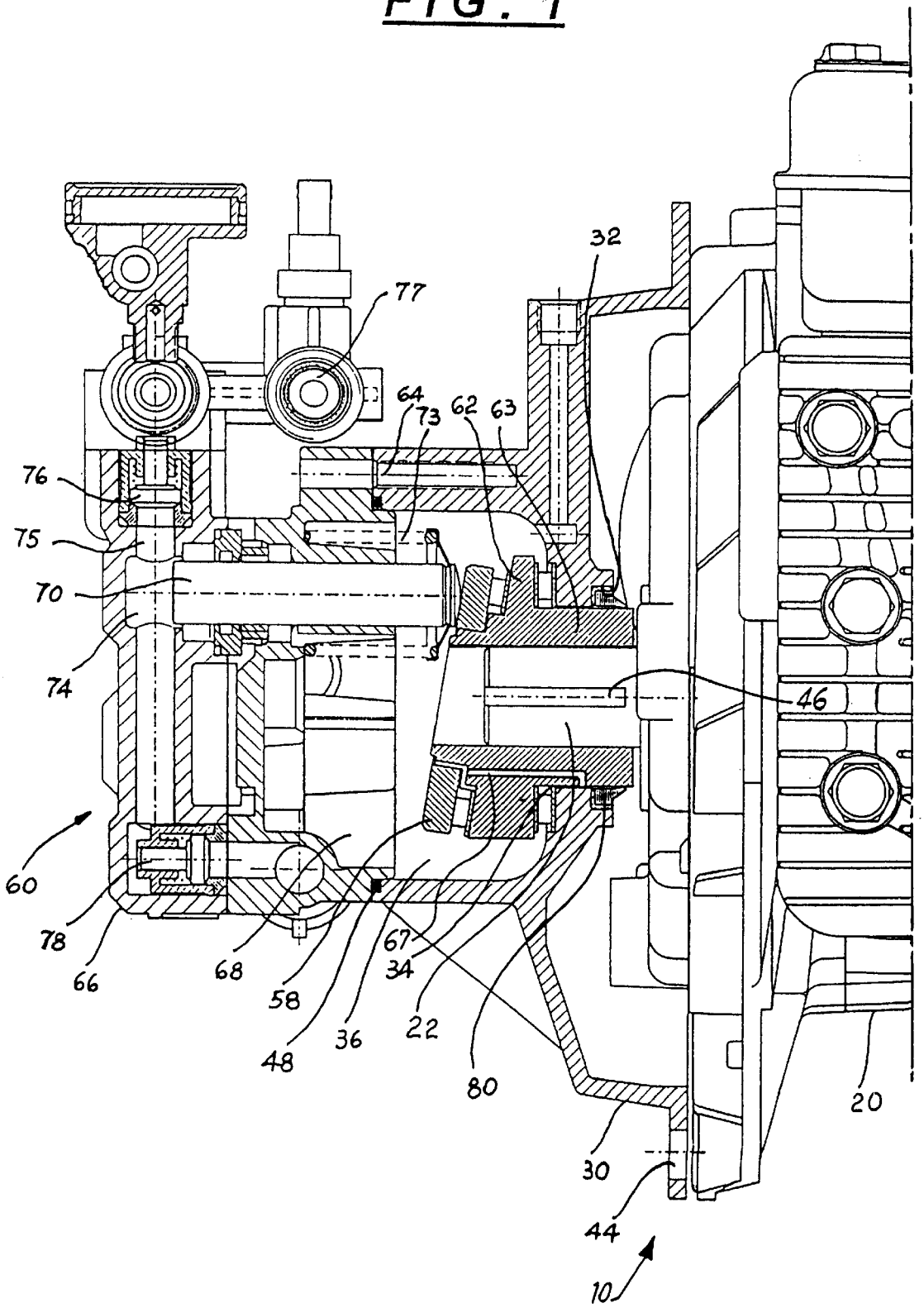
FIG. 1 is a cutaway cross-section view of a portion of an embodiment of the high pressure water pump system of the present invention that includes an intermediate flange and an axial drive piston pump.
Figure 2:
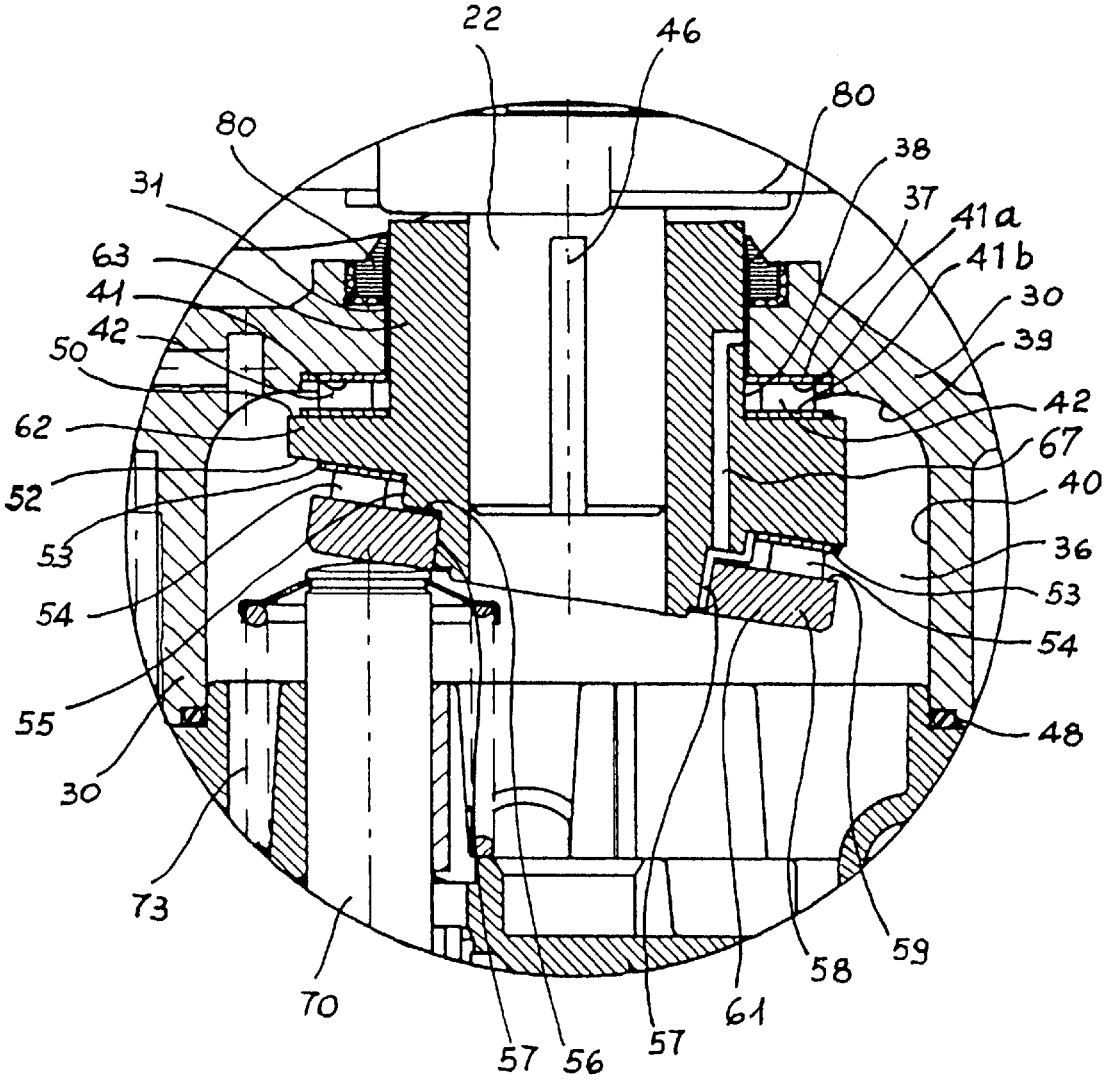
FIG. 2 is a close-up side cross-section view of a portion of the intermediate flange useful in the high pressure water pump system of FIG. 1.

It should be understood that terms used herein as "top", "bottom", "end,""first", "second", and "associated with" have reference only to the structures shown in the drawings as they would appear to a person viewing the drawings and are used merely to simplify the description of this invention. The figures are drawn to show the basic teachings of the present invention, including the position relationships of the parts that perform various functions of the invention. Unless explained in detail, the dimensional proportions, materials of construction and so forth are well within the understanding of those skilled in the art.

DESCRIPTION OF THE PREFERRED EMBODIMENTS

The present invention relates to a high pressure water pump system that is driven by a motor that may be vertically or horizontally mounted. By "vertically mounted" it is meant that the motor drive shaft is oriented vertically and downwardly. By "horizontally mounted" it is meant that the motor drive shaft is oriented horizontally. A motor associated with an intermediate flange and an axial drive pump defines a pump system of this invention that is short and compact.

The high pressure water pump system of this invention is designated by the numeral 10 in the various figures. Pump system 10 includes a motor 20, an axial drive pump 60, and an intermediate flange 30 for uniting motor 20 with axial drive pump 60.

Pump system 10 of this invention includes a motor 20 having a drive shaft 22 (in the figures the drive shaft is shown horizontally oriented).

Motor 20 may be any type of motor that can provide sufficient torque to operate axial drive pump 60. Preferably, motor 20 is an electric motor or internal combustion engine of the type used for consumer upright lawn mowers. Such motors can generate 3 to 10 horsepower, allowing pump system 10 of this invention to generate 1,500 to 4,000 psi of water pressure.

Preferably, motor 20 is an internal combustion engine.

Motor 20 is associated with drive shaft 22 and causes it to rotate axially. The intermediate flange 30 united motor 20 and drive shaft 22 with pump 60 and allows drive shaft 22 to rotate.

The intermediate flange 30 also aids in efficiently transferring the rotational power of drive shaft 22 to axial drive pumps 60.

The intermediate flange 30 includes an aperture 32, located approximately in the center of intermediate flange 30, a first recess 34 and a second recess 36 which both include aperture 32.

First recess 34 and second recess 36 are coaxial to aperture 32.

First recess 34, having limited height, is defined by a first circumferential face 37 and a first cylindrical wall 38. Second recess 36 is defined by second circumferential face 39 and second cylindrical wall 40. Between the aperture 32 and the first recess 34, the intermediate flange defines a cylindrical wall 31 having a diameter slightly smaller than the diameter of the wobble disk assembly rear 63.

First recess 34 is sized to accept axial thrust bearing 41 and of the wobble disk assembly 62. Second recess 36 is sized to accept wobble disk assembly 62.

The intermediate flange 30 is associated with motor 20 by any means known in the art for uniting a flange with a motor. It is preferred that the intermediate flange 30 is removably and compressibly associated with motor 20 with bolts that pass from axial drive pump 60 into motor 20 via intermediate flange 30. As shown in the Figures, the intermediate flange 30 includes a plurality of first bolt apertures 44, and preferably three first bolt apertures 44 located at 120° intervals around the circumference of intermediate flange 30.

The intermediate flange 30 is also removably attached to axial pump 60 by any releasable attaching means known to one of skill in the art including, but not limited to bolts, a C-clamp and the like. It is preferred that pump 60 includes a plurality of pump apertures 64 for conventional bolts.

In the preferred pump system 10, bolts are passed upwardly through pump bolt apertures 64 into a complementary threaded aperture in motor 20 (not shown). As the bolts are tightened, intermediate flange 30 is compressed between motor 20 and axial pump 60. Alternatively, a first attaching means can be used to unite motor 20 and intermediate flange 30, and a second separate attaching means can be used to unite intermediate flange 30 with axial pump 60. The first and second attaching means may be an attaching device known in the art for reversibly uniting two objects such as bolts, clamps, threaded connectors and the like. What is important is that intermediate flange 30 is releasably secured between motor 20 and pump 60.

A scraper ring 80 is located in the aperture 32 of intermediate flange 30.

Scraper ring 80 is inserted in the aperture 32 in such a manner that it allows the wobble disk assembly 62 to rotate.

When it is connected to pump system 10 of this invention, scraper ring 80 ensures the efficient sealing between intermediate flange 30 and wobble disk assembly 62.

Drive shaft 22 is keyed directly to the end of the wobble disk assembly 62, which is provided with a longitudinal aperture whose diameter corresponds to the diameter of the drive shaft. Drive shaft 22 may be keyed to wobble disk assembly 62 by any means known in the art that allows the drive shaft and the wobble disk assembly 62 to freely rotate in unison. It is preferred that wobble disk assembly 62 is associated with drive shaft 22 using a through key 46, a set screw or by any similar attaching method.

The wobble disk assembly 62 has a length at least equal to its diameter and it is provided with a seat or recess for a connection means to drive shaft 22.

At least one thrust bearing is associated with intermediate flange 30 and with wobble disk assembly 62 in a manner that allows wobble disk assembly 62 to rotate freely while intermediate flange 30 remains stationary.

A preferred thrust bearing consist of two thrust washers 41*a* and 41*b* sandwiching at least on cylindrical or spherical roller 42. It is preferred that a thrust bearing is located in the first recess 34 of the intermediate flange 30 with first thrust washer 41*a* located in a seat defined by first recess 34 and second thrust washer 41*b* abutting back wall 50 of wobble disk assembly 62.

Wobble disk assembly 62 includes a front wall 52. Front wall 52 includes a first circumferential indentation formed by shoulder 55. The first circumferential indentation holds a third thrust washer 53.

Front wall 52 also includes a second indentation defined by a circumferential surface 56 and cylindrical wall 57. Second indentation is sized to be large enough to accept plate 58.

Plate 58 includes a plate aperture having a diameter essentially equal to the diameter of front end 52 of wobble disk assembly 62. Third thrust washer 53, plate 58, and second cylindrical or spherical rollers 54 are associated with wobble disk assembly 62 such that second cylindrical or spherical rollers 54 are located between inner surface 59 of plate 58 and third thrust washer 53.

Furthermore, third thrust washer 53 is associated with first indentation and abuts the top surface of the second cylindrical or spherical roller 54.

Plate 58 includes a bottom surface that contacts pistons 70 of axial drive piston pump 60.

The entire front face 61 of plate 58 is oriented eccentrically. This allows pistons 70 to be actuated by wobble disk assembly 62 when wobble disk assembly is rotated as will be described below.

Wobble disk assembly 62 can be provided with a through hole or with a dead hole; the presence of the through hole facilities the manufacture of the wobble disk assembly.

Wobble disk assembly 62 can be also provided with a duct 67 connecting the second recess 36 with the contact surface between the wobble disk assembly 62 and the intermediate flange 30, in order to lubricate said contact surface with the lubricating oil contained in the oil-filled pump chamber 68.

Intermediate flange 30 may include an optional first "O"-ring 48, located in the point where intermediate flange 30 and pump 60 are united. "O"-ring 48 creates a seal that prevents ingress and regress of material to and from oil-filled pump chamber 68, when intermediate flange 30 is compressively associated with pump 60.

Pump system 10 of this invention includes an axial drive pump 60. Any type of axial drive pump 60 may be used with this invention. Preferably, however, pump system 10 includes an axial drive piston pump.

While an understanding of the precise operation of the preferred axial drive piston pump 60 of the present invention is not necessary to allow those skilled in the art to practice this invention, an explanation of the operation of the preferred axial drive piston pump 60 is included for a full understanding of the high pressure water pump system 10 of this invention.

Axial drive piston pump 60 is contained within pump housing 66 and includes an oil-filled pump chamber 68 containing three pistons 70. Pump 60 includes a wobble disk assembly 62 that further includes plate 58. Wobble disk assembly 62 may be attached to end of drive shaft 22 by any means known in the art, preferably by a through-key 46.

Wobble disk assembly 62 fits partially into second recess 36 of intermediate flange 30, and passes through the aperture associated with wobble disk assembly 62, freely rotates within first recess 34 and second recess 36.

Wobble disk assembly 62 actuates pump 60 via the rotation of drive shaft 22. Rotations of drive shaft 22 cause wobble disk assembly 62 to rotate around a fixed axis. Plate 58 continuously contacts a plurality of pistons 70 associated with pump 60 and the rotation of wobble disk assembly 62 also rotates plate 58.

The wobble disk assembly 62 and the plate 58 rotate in a non-planar, eccentric manner with respect to pistons 70, thereby causing each of the plurality of pistons 70 to go through a full range of vertical motions for each rotation of eccentric plate 58.

As plate 58 rotates, it moves piston 70 away from motor 20 and towards pumps 60, thereby causing water to flow through outlet check valve 78 and through outlet port 77. Upon further rotation, plate 58 begins to move towards motor 20 and away from piston 70, causing spring 73 to urge piston 70 away from water flow chamber 74 and towards plate 58, thereby drawing water into inlet port 75 and through inlet check valve 76. Upon further rotation, plate 58 once again urges piston 70 towards water flow chamber 74, causing water pressure in the chamber to increase and water once again flows through check valve 78 and outlet port 77. Preferably, the axial drive piston pump 60 includes three pistons 70 which operate in unison but out-of-phase to produce a constant high pressure stream of water.

Thrust washers 41*a*, 41*b* and 53 and cylindrical or spherical roller 42, 54 suitably contrast the axial thrust movement of the wobble disk assembly 62 and the relative plate 58; the latter constitutes a further thrust bearing. Plate 58, thrust washers 41*a*, 41*b*, 53 and rollers 42, 54 are systematically and axially compressed by the pistons 70 which keeps them in position, with no need for specific connection means.

Figure 3:
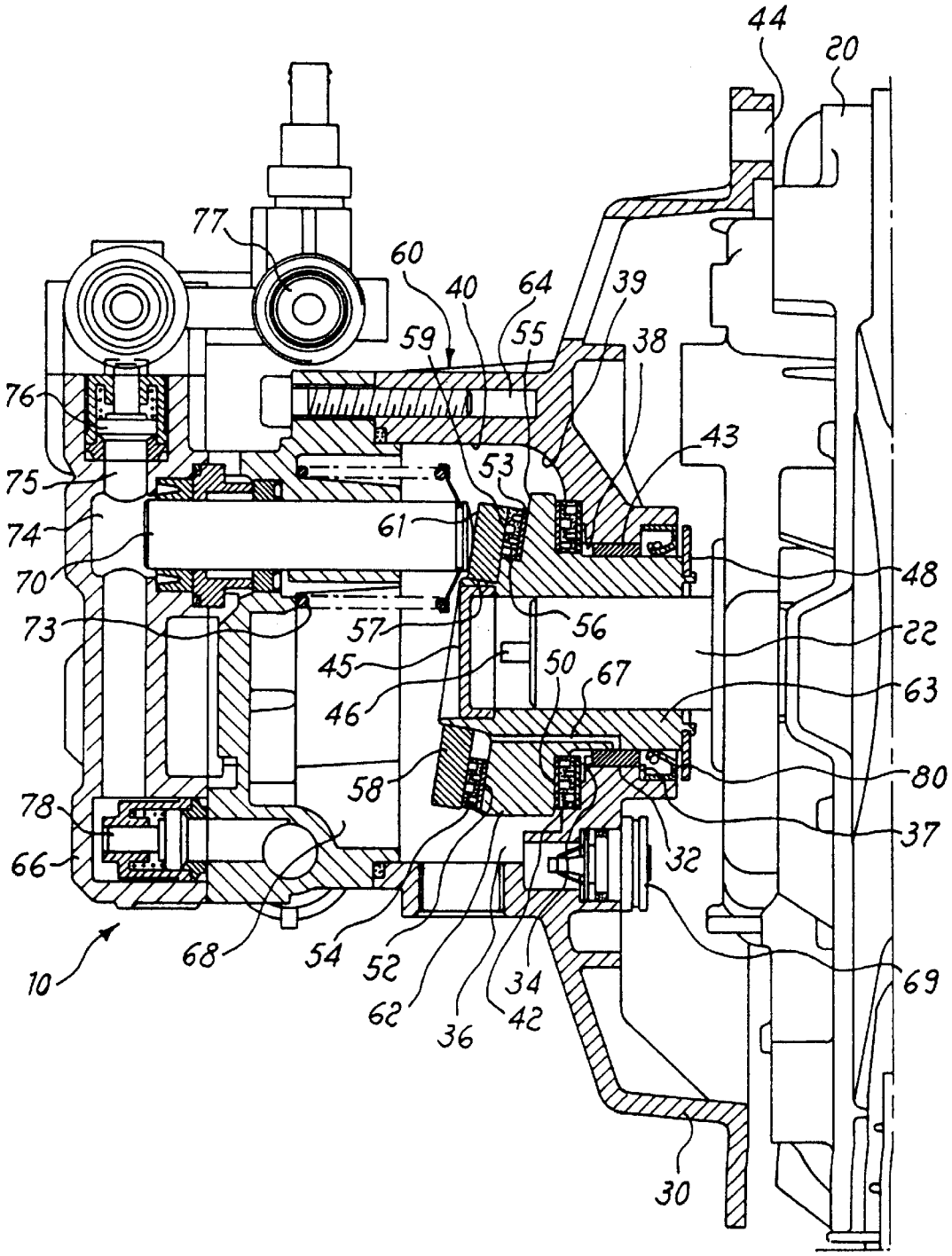
FIG. 3 is a cutaway cross-section view of a portion of a second preferred embodiment of the high pressure water pump system of the present invention that includes an intermediate flange and an axial drive piston pump.

According to a preferred embodiment of the high pressure water pump system of the present invention, illustrated in FIG. 3, the cylindrical wall 38 of first recess 34 of the intermediate flange 30 defines a cylindrical chamber having a diameter greater than the diameter of the rear portion 63 of the wobble disk assembly 62.

Wobble disk assembly 62 may include a bushing 43 associated with wobble disk rear portion 63.

Bushing 43 is preferably press-fits into the cavity defined by cylindrical wall 38 and wobble disk rear portion. Bushing 43 separates wobble disk rear portion 63 from intermediate flange 30. Bushing 43 is coaxial with drive shaft 22 and may be manufactured from sintered ferrous material or self-lubricating plastic material. Bushing 43 stabilizes and centers the wobble disk assembly 62. The thickness of bushing 43 is not critical and may range from 0.01 to 20 mm, preferably from 0.5 to 10 mm, and its height is lower that the height of the first cavity 34, so as to be contained in said first cavity.

Besides, at the end of the wobble disk assembly 62, a plug 45 is applied, preferably having a "U"-shaped section, and whose side surface is pressure-fitted into a cylindrical cavity obtained in the axial through-hole of the wobble disk assembly 62. Said plug 45 prevents lubricating oil or its vapor from seeping between the drive shaft 22 and the axial through-hole of the wobble disk assembly 62 into motor unit 20. Such plug 45 may be manufactured from plastic material, in particular of oil-resistant plastic material.

A metal disk 48 may be fixed at the end of the wobble disk assembly 62 oriented towards motor 20. Such fastening may be obtained by any means known to those skilled in the art, such as, for instance, by riveting. Metal disk 48 has the function of preventing disk 62 of the drive shaft 22 from unthreading during the assembly of the pump.

A plug 69, preferably provided with a valve, may be located on the intermediate flange 30, to allow breathing of the motor oil.

The arrangement of a bushing 43 on the back part of the wobble disk assembly allows the precise and easy centering of the same disk on the flange, independently on the type of pump as concerns orientation and makes assembly operations substantially easier.

Besides, the presence of a plug or lid 45 at the end of the wobble disk assembly 62 allows to mount the motor in any position, either horizontally or vertically, with no danger of the lubricating oil seepage.

The wobble disk assembly 62 of the high pressure water pump system of the present invention comprises:

- an inclined front surface consisting of a plate which through the thrust bearings transforms the rotation of the drive shaft to alternate motion of the pistons;
- a surface opposite to the inclined front surface suitable to discharge the thrust of the pistons directly to the intermediate flange through the thrust bearings;
- an axial hole having a diameter slightly higher than the diameter of the drive shaft to perform a sliding fit; the inner surface of the hole having a seat for a means connecting the drive shaft to the wobble disk assembly;
- a cylindrical surface coaxial to the hole to assure the oil-seat through the scraper ring seal and the centering by the bushing or intermediate flange, and
- a duct for oil transfer from the second recess to the contact surface of the wobble disk assembly to the intermediate flange.

Although the invention has been described in conjunction with specific embodiments, offered for illustrative purpose only, it is evident that many alternatives and variations will be apparent to those skilled in the art, in the light of the foregoing description.

Accordingly, the invention is intended to embrace all of the alternatives and variations that fall within the spirit and scope of the appended claims.

I claim:

1. A high pressure water pump system comprising: a motor (20) with a drive shaft (22); an intermediate flange (30) having an aperture (32) extending actually through said flange, said aperture (32) defining a first recess (34) and a second recess (36) coaxial to said aperture (32); an axial drive piston pump (60); said intermediate flange (30) being secured between said motor (20) and the axial drive piston pump (60); a wobble disk (62) secured to an end of the said motor drive shaft (22) and at least partially located in the second recess (36) of the intermediate flange (30); at least one thrust bearing mounted in the first recess (34) of said intermediate flange (30), said at least one thrust bearing consisting of a first thrust washer **(41*a*), a second thrust washer (41*b*) and at least one roller (42)** located between the first washer and the second washer.

2. The high pressure water pump system of claim 1, in which said wobble disk (62) includes a rear portion and an opposed front wall (52), said wobble disk being formed with a first indentation and a second indentation located between the wobble disk front wall (52) and rear portion; said first indentation forming a shoulder (55) and said second indentation defining a circumferential surface (56) and a cylindrical wall (57), a third thrust washer abutting the first indentation shoulder and at least one roller being located in the first indentation adjacent said third thrust washer.

3. The high pressure water pump system according to claim 1 including a scraper ring seal (80) located in said aperture (32) of the intermediate flange (30).

4. The high pressure water pump system according to claim 1 in which said motor (20) is an internal combustion engine.

5. The high pressure water pump system according to claim 1 in which said wobble disk has a rear portion (63) disposed within said first recess (34) of the intermediate flange (30) having a diameter grater than the diameter of the rear portion (63) of the wobble disk (62), and a bushing (43) is press-fit into a space defined by said first recess and the wobble disk rear portion (63).

6. The high pressure water pump system according to claim 5 in which said bushing (43) is made of a material selected from the group consisting of the sintered ferrous material and self-lubricating plastic material.

7. The high pressure water pump system according to claim 5 in which said bushing (43) has a thickness of from 0.10 to 20 mm and a height smaller than the height of the first recess (34) of the intermediate flange (30).

8. The high pressure water pump system according to claim 7 in which said bushing (43) has a thickness between 0.5 and 10 mm.

9. The high pressure water pump system according to claim 1 in which said wobble disk has an end with a plug (45) manufactured from an oil-resistant material.

10. The high pressure water pump system according to claim 9 in which said plug (45) is "U"-shaped.

11. The high pressure water pump system according to claim 10 in which said wobble disk (62) has an axial through-hole and a side surface of said plug (45) is pressure-fit into a cylindrical cavity in said axial through-hole of the wobble disk (62).

12. The high pressure water pump system according to claim 1 in which said wobble disk assembly (62) is formed with an axial dead hole.

13. The high pressure water pump system according to claim 1 in which a metal disk (48) is fixed to a rear portion of the wobble disk (62) to prevent the wobble disk from disengaging from the motor drive shaft during assembly of the pump system.

14. The high pressure water pump system according to claim 1 in which said intermediate flange (30) includes a plug (69) having a valve for motor oil breathing.

15. The high pressure water pump system according to claim 1 in which said wobble disk (62) includes a duct (67) connecting the second recess (36) with a contact surface between the wobble disk assembly (62) and the intermediate flange (30).

16. The high pressure water pump system according to claim 1 in which said wobble disk comprises:

an inclined front surface consisting of a plate which through the at least one thrust bearing transforms the rotation of the drive shaft to alternate motion of the pistons;

a surface opposite to the inclined front surface suitable to discharge the thrust of the pistons directly to the intermediate flange through at least one thrust bearing;

an axial hole having a diameter slightly greater than the diameter of the drive shaft to effect a sliding fit; an inner surface of the hole having a seat for a means connecting the drive shaft to the wobble disk assembly;

a cylindrical surface coaxial to the hole to assure the oil-seat through the scraper ring seal and the centering by the bushing and intermediate flange, and a duct for oil transfer from the second recess to the contact surface of the wobble disk to the intermediate flange.

17. A high pressure water pump assembly comprising an internal combustion engine (20) including a drive shaft (22) having an end;

an axial drive pump (60) operated by the drive shaft;

an intermediate flange (30) secured between the axial drive pump (60) and motor (20), said intermediate flange having an aperture (32) extending actually through the flange, said flange aperture (32) defining a first recess (34) and a second recess (36) coaxial to said aperture (32);

a wobble disk (62) associated with the motor drive shaft and at least partially located in the second recess (36), said wobble disk (62) including a rear portion and a front end; said wobble disk (62) being formed with a first indentation that defines a shoulder;

at least one thrust bearing including a first thrust washer at least partially located in said first recess, a second thrust washer abutting the wobble disk first indentation shoulder, and at least one roller located in between the first and second thrust washers; and, a bushing (43) press-fit over at least a portion of the wobble disk rear portion and located between the wobble disk rear portion and the intermediate flange aperture.

18. The high pressure water pump assembly according to claim 17 including a plug mounted in a front end of said wobble disk.

19. A high pressure water pump system comprising: a motor (20) with a drive shaft (22); an intermediate flange (30) having an aperture (32) extending axially through said flange, said aperture defining a first recess (34) coaxial to said aperture (32); an axial drive piston pump (60); said intermediate flange (30) being secured between said motor (20) and the axial drive piston pump (60); a wobble disk (62)

secured to said motor drive shaft (22) and disposed within said aperture (32); a first thrust bearing mounted in said first recess (34) of said intermediate flange (30), said first thrust bearing including a first thrust washer (41*a*) disposed adjacent a circumferential wall (37) of said first recess (34), a second thrust washer (42*b*) disposed adjacent a circumferential wall (50) of said wobble disk (62), and at least one roller (42) located between said first and second washers (41*a*, 41*b*).

20. The high pressure water pump system of claim 19 in which said wobble disk has a second circumferential wall (52), and including a second thrust bearing including a third thrust washer (53) disposed adjacent said second circumferential wall (52), and at least one roller (54) disposed adjacent said third washer (53) for transmitting axial forces between said wobble disk (62), said third thrust washer (53) and said axial piston pump (60).

21. A high pressure water pump system comprising: a motor (20) with a drive shaft (22); an intermediate flange (30) having an aperture (32) extending axially through said flange, and a first recess (34) coaxial to said aperture (32); an axial drive piston pump (60); said intermediate flange (30) being secured between said motor (20) and the axial drive piston pump (60); a wobble disk (62) secured to said motor drive shaft (22) and disposed within said aperture (32); a first thrust bearing mounted in said first recess (34) of said intermediate flange (30), said first thrust bearing including a first thrust washer (41*a*) disposed adjacent a circumferential wall (37) of said first recess (34), a second thrust washer (42*b*) disposed adjacent a circumferential wall (50) of said wobble disk (62), and at least one roller (42) located between said first and second washers (41*a*, 41*b*); and said wobble disk being supported within said flange aperture by a bushing (34) mounted in direct interposed relation between said flange aperture (32) and wobble disk (62).

22. The high pressure water pump system of claim 21 in which said bushing (43) is press fit over a rear portion of said wobble disk.

23. The high pressure water pump system of claim 22 in which said wobble disk has a second circumferential wall (52, and including a second thrust bearing including a third thrust washer (53) disposed adjacent said second circumferential wall (52), and at least one roller (54) disposed adjacent said third washer (53) for transmitting axial forces between said wobble disk (62), said third thrust washer (53) and said axial piston pump (60).

* * * * *